United States Patent [19]

Saunders

[11] Patent Number: 4,875,597

[45] Date of Patent: Oct. 24, 1989

[54] CONVENIENCE PACKAGING

[75] Inventor: William T. Saunders, Weirton, W. Va.

[73] Assignee: Weirton Steel Corporation, Weirton, W. Va.

[21] Appl. No.: 279,403

[22] Filed: Dec. 2, 1988

[51] Int. Cl.[4] ..... B65D 1/14; B65D 25/34

[52] U.S. Cl. ..... 220/458; 72/347; 219/10.55 E; 220/67; 220/83; 413/6; 426/107; 426/131

[58] Field of Search ..... 72/46, 347–349; 53/456; 219/10.55 E; 220/66, 67, 71, 72, 83, 458; 413/1, 71, 76, 6; 426/107, 113, 115, 126, 131

[56] References Cited

U.S. PATENT DOCUMENTS

| | | | |
|---|---|---|---|
| 4,278,716 | 7/1981 | Buchner et al. | 426/126 |
| 4,366,696 | 1/1983 | Durgin et al. | 72/348 |
| 4,405,058 | 9/1983 | Phalin | 220/70 |
| 4,412,440 | 11/1983 | Phalin et al. | 72/46 |
| 4,452,375 | 6/1984 | Marcus | 72/46 |
| 4,503,702 | 3/1985 | Bulso, Jr. et al. | 72/348 |
| 4,641,005 | 2/1987 | Seiferth | 426/126 |

FOREIGN PATENT DOCUMENTS

| | | | |
|---|---|---|---|
| 2451511 | 5/1976 | Fed. Rep. of Germany | 72/347 |
| 1284805 | 8/1972 | United Kingdom | 426/113 |
| 2076692 | 12/1981 | United Kingdom | 220/458 |

*Primary Examiner*—Jimmy G. Foster

*Attorney, Agent, or Firm*—Raymond N. Baker; Shanley and Baker

[57] ABSTRACT

A rigid sheet metal substrate can body (50) and end closure (92) provides dependable tamper-evident and abuse-resistant packaging for shipment and long shelf-life storage without freezing; and, in addition, provides for direct heating in the can body after opening, including microwave heating, for serving and/or eating directly from such disposable container. The can body is shaped by draw processing with diminishing cross sectional areas in proceeding height-wise from open end (61) to closed bottom wall (56).

20 Claims, 5 Drawing Sheets

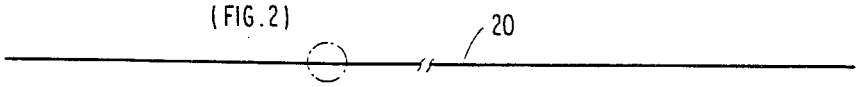
FIG.1
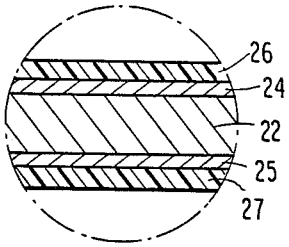
FIG.2
FIG.3
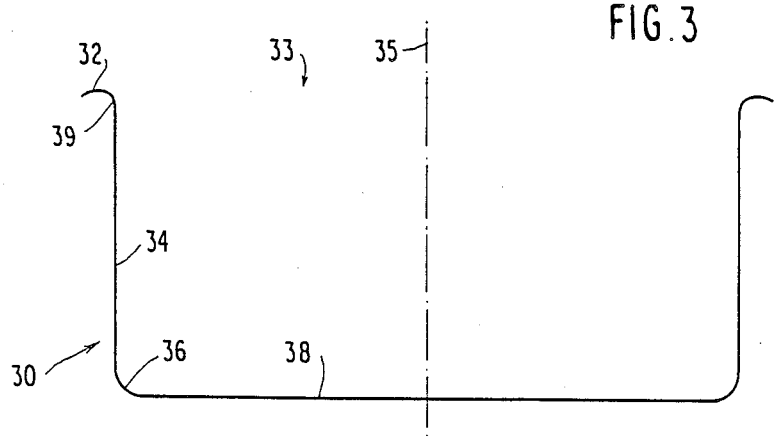
FIG.4
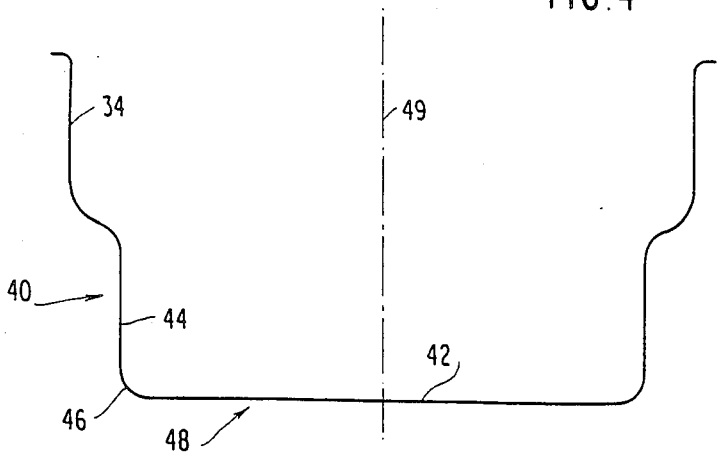

FIG.12
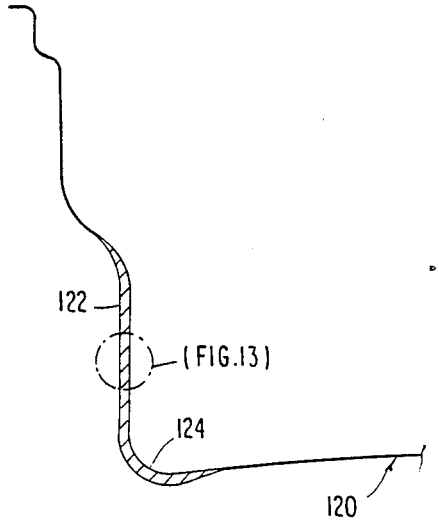
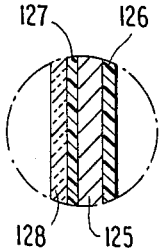
FIG.13
FIG.14
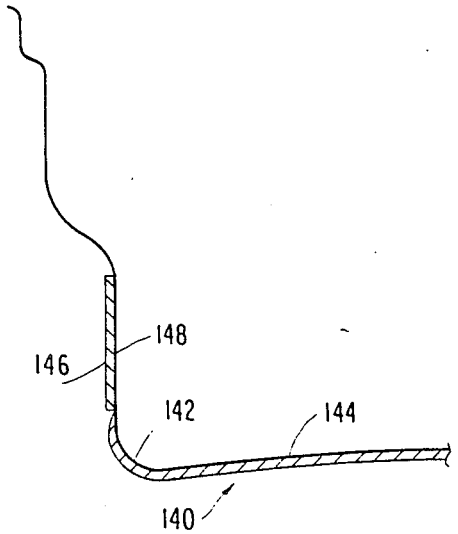

CONVENIENCE PACKAGING

This invention relates to convenience packaging. More specifically, this invention is concerned with a dependable, rigid sheet metal substrate, disposable can body and integral convenience-feature end closure structures capable of providing for shipment and long shelf-life storage of comestibles without freezing; in addition, such comestibles can be heated directly in the can body, including being heated safely in a microwave oven; and, in addition, such can body is fabricated so as to comprise a dish for serving or consuming heated contents directly in a manner which is readily acceptable to the palate because of the similarity in appearance of the opened package to dining ware.

The present teachings (1) avoid any requirement for transfer of package contents to a separate plate, bowl, or the like for any purpose, (2) offer numerous advantages for microwave heating in providing a sturdy reliable container which is safely microwavable and free from the warping or distortion customarily experienced with the type of packaging used for frozen comestibles during heating, and (3) provide packaging which is easier to handle before and after heating.

In addition, in a specific embodiment of the invention, such convenience packaging is easily reclaimable for recycling and is bio-degradable if not reclaimed.

Specific embodiments of the invention are shown in the accompanying drawings, in which:

FIG. 1 is a schematic edge elevational view of a rigid metal substrate blank as used in the present invention;

FIG. 2 is an enlarged cross-sectional view of one embodiment of a coated metal substrate for the blank of FIG. 1;

FIG. 3 is a schematic cross-sectional view of a work product drawn from the blank of FIG. 1;

FIG. 4 is a schematic cross-sectional view of the work product redrawn from that of FIG. 3;

Figure 5:
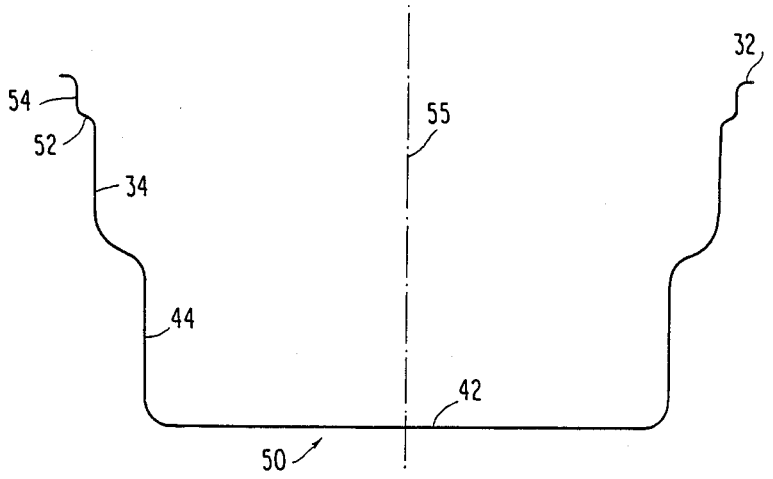
Figure 6:
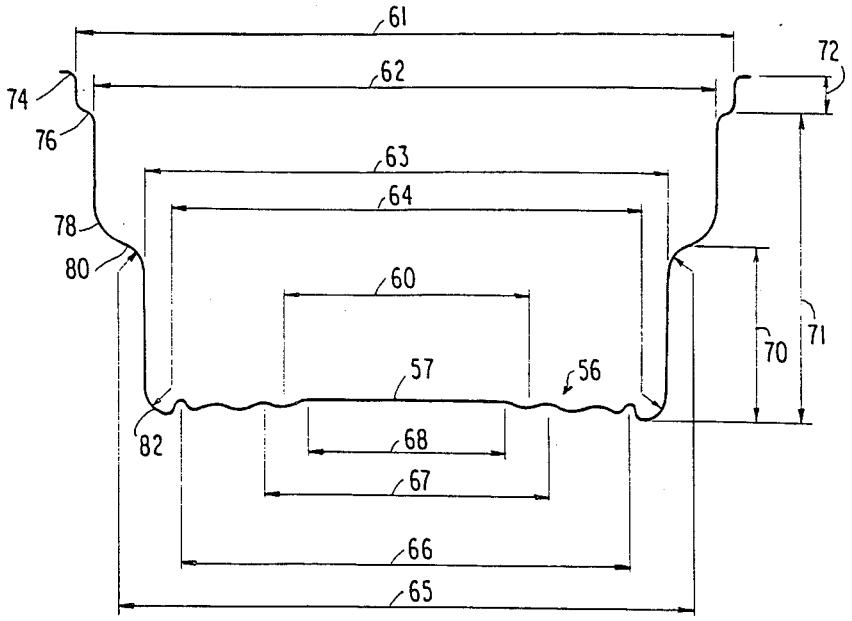
Figure 7:
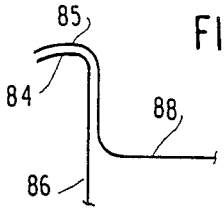
Figure 8:
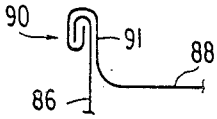
Figure 9:
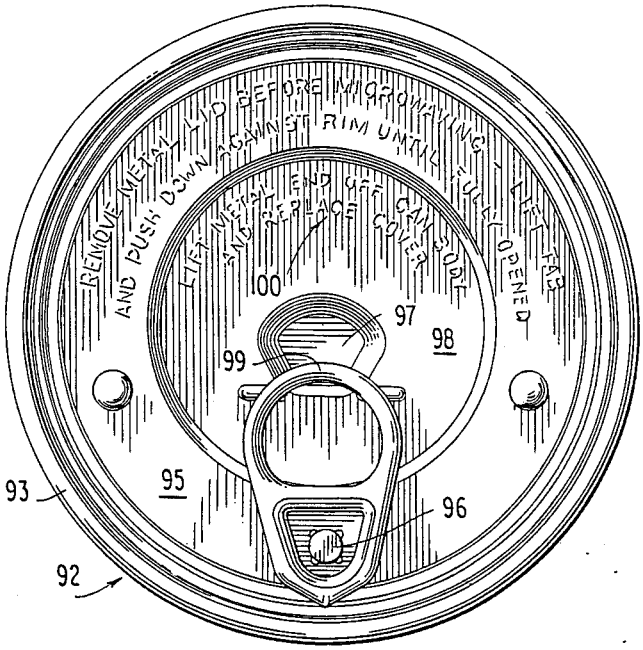
Figure 10:
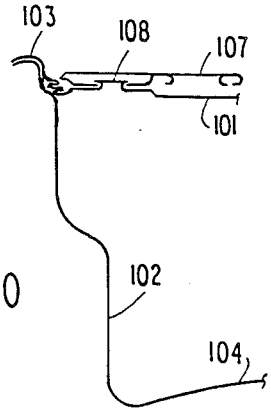
Figure 11:
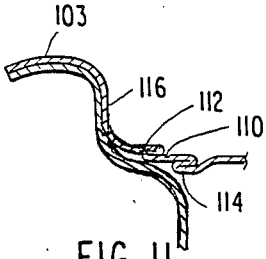
Figure 15:
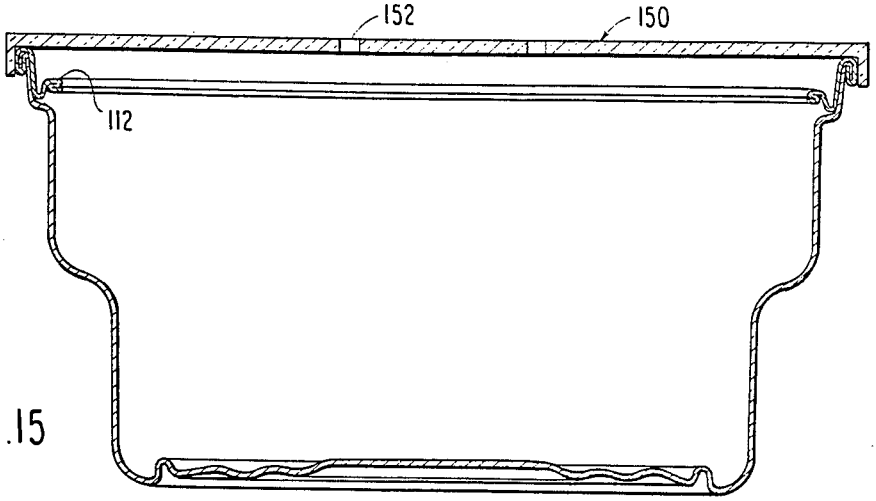
Figure 16:
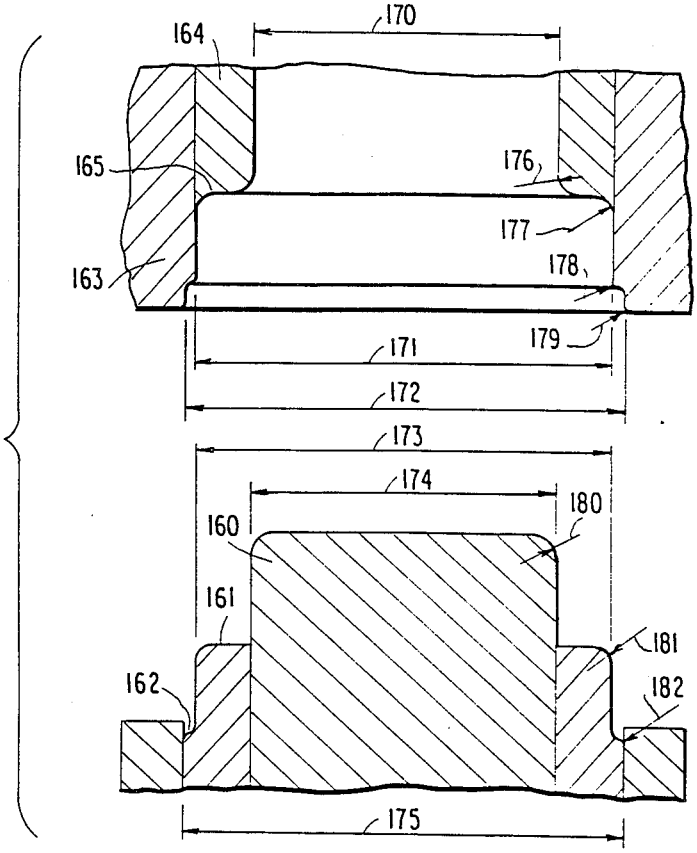

FIG. 5 is a schematic cross-sectional view of a work product sequential to that of FIG. 4 showing a can body embodiment of the invention shaped solely by draw processing, FIG. 6 is a schematic cross-sectional view of a specific embodiment for indicating dimensional and other characteristics of a draw-redraw can body of the invention in which the final redraw and bottom wall profiling are carried out on the redrawn work product of FIG. 4;

FIGS. 7 and 8 are schematic cross-sectional partial views for describing a specific embodiment juncture means for a can body and end wall closure of the invention;

FIG. 9 is a top plan view showing a convenience-feature end closure in use on a cylindrical can body embodiment of the invention;

FIG. 10 is a schematic, cross-sectional, partial view of a rigid metal-substrate can body and convenience feature end closure embodiment of the invention, with FIG. 11 showing a portion of the end closure and can body sidewall of FIG. 10 in enlarged form;

FIG. 12 is a schematic cross-sectional view of a portion of the sidewall, bottom-wall and interconnecting transition zone of a can body embodiment showing integral insulating material covering a portion thereof, with FIG. 13 being an enlarged cross sectional view of a sidewall portion of the embodiment of FIG. 12;

FIG. 14 is a schematic cross-sectional view of a portion of the sidewall, bottom-wall and intermediate transition zone of a metal-substrate can body embodiment with integral insulating coaster means covering portions of such transition zone and bottom wall, and FIG. 15 is a schematic cross-sectional view of an opened can with cover means, and FIG. 16 is a cross-sectional partial view of tooling for an embodiment of the invention for setting forth dimensional characteristics.

In accordance with present teachings a rigid metal-substrate, one-piece can body is formed from a metal substrate blank solely by draw processing to present a sidewall defining multiple cross-sectional areas between its open end and closed end. The closed end of the can body is oriented generally perpendicularly transverse to a centrally located axis of the can body; and, such axis is perpendicular to cross-sectional planes at the open and closed ends of the can body. The can body sidewall is symmetrically disposed with relation to such central axis and such multiple cross-sectional areas are measured in planes perpendicularly transverse to such axis.

The multiple sidewall portions defining such differing cross-sectional areas are separated by curvilinear cross-sectional transition zones. Selecting such cross-sectional areas and interrelating dimensions of transition zones between such areas to accomplish the desired can body configuration are significant teachings of the invention. The rigid sheet metal substrate is precoated with organic coating and draw lubricant in the coil stage prior to draw processing; the latter term refers to shaping the metal substrate and reshaping without "ironing"— that is, without sidewall ironing to produce a decrease in thickness gage. Describing a can body as shaped entirely by draw processing is without reference to such steps as trimming of flange metal.

An organic coating is resented on both interior and exterior surfaces of the drawn can body. The term "organic coating" is used in the can industry to refer to organic polymeric coatings such as vinyls, epoxys, polyesters and the like, or combinations thereof, which are applied in a solvent form, or as film, to sheet metal or sheet metal substrate. Such organic coatings are approved by the FDA and typical suppliers are The Valspar Corporation of Pittsburgh, Pa., Dexter Corporation-Midland Division of Waukegan, Ill., BASF Corporation-Inmont Division of Clifton, N.J. and DeSoto, Inc of Des Plaines, Ill.

The draw processing taught does not disturb coating adhesion of the organic coating as applied. Adhesion of the organic coating as applied is improved for fabrication and use purposes by first coating the base metal with an intermediate layer, preferably a metallic-material such as chrome-chrome oxide. Flat rolled steel coated with chrome-chrome oxide is referred to as tin-free steel (TFS). Chrome-chrome oxide, and other selected metallic material coatings or chemical treatments for steel, as disclosed herein, facilitate uniform coating and adhesion of organic coatings for forming a composite-coated, rigid sheet metal can body of the invention.

The one-piece can body of the invention provides for a significantly greater cross section dimension and area, in a plane perpendicularly transverse to the centrally located axis, at the open end of the can body than at the closed end; and, also, provides for a plurality of differing cross-sectional areas between such open and closed ends which diminish in cross-sectional area from that of the open end in approaching such closed end.

Shaping of the can body as taught herein improves open-end access to facilitate serving and/or eating directly from the package in a normal and acceptable manner and, also, improves access and utilization of microwaves for heating the contents; preset draw stroke processing is taught and achieves desired shaping with optimum efficiency.

The metal-substrate blank 20 of FIG. 1 is cut from coil can stock which has been precoated on both its surfaces with organic coating and draw lubricant for fabricating the multi-dimensional sidewall configuration of the invention.

An embodiment of blank 20, shown in the enlarged cross-sectional view in FIG. 2, includes base metal 22, an intermediate coating 24, 25 and an organic coating 26 on the surface which will be exposed on the interior of the work product during draw and redraw in accordance with FIGS. 3–5; and, organic coating 27 is provided on the external surface which will be exposed on the exterior of the work product during draw-redraw. "work product" as used herein includes can bodies of the cylindrical and non-cylindrical classifications as defined in the canmaking industry in which non-cylindrical includes, e.g., oblong and oval.

The intermediate coating of the base metal shown at 24, 25 is preferably a metallic material coating such as chrome-chrome oxide; however, when using flat rolled steel other coatings can be selected from the group consisting of chrome oxide (batch treatment or electrolytic treatment) tin, tin-iron alloy, or tin and tin-iron alloy. Also, chemical cleaning and treatment of blackplate can provide a suitable foundation for satisfactory adhesion of certain organic coating systems for present purposes.

Chrome oxide or tin-iron alloy provides improved adhesion for most of the organic polymeric coatings approved by the U.S. Food and Drug Adminstration. Such metallic-material coatings are identified in MAKING, SHAPING AND TREATING OF STEEL, 10th ED., ©1985 . Association of Iron and steel engineers, published by Herbick & Held, Pittsburgh, Pa., pages 1139, 1140; coating methods and specifications for such base metal treatments or coatings are also available in the art.

The organic coating 24, 25 can be a single organic polymer or a dual-organic coating system (as set forth in pending U.S. application Ser. No. 855,694, filed Apr. 25, 1986 by the present applicant and assigned to the assignee of the present application). An organic coating weight of about ten (10) mg/sq inch is used on each surface of a 65#/bb tin mill product. Such organic coating in combination with other features of the invention provides protection and enables safe microwaving as described in more detail later herein; and, provides erosion and corrosion protection for the metal substrate. The organic coating in combination with other contributions enables draw processing to fabricate the FIGS. 3 through 5 configurations or other configurations for presenting differing cross-sectional areas in a unitary can body.

Another feature relates to selection of pigmentation for the organic coating. Pigmentation is important to the food-serving contribution of the invention; and, white pigmentation is preferred for both surfaces but, in particular, for the organic coating on the interior of the container.

Blank 20 is drawn so as to form unitary shallow-depth work product 30 (FIG. 3) with flange metal 32 outwardly from its open end 33 as defined by sidewall 34. Work product 30 is symmetrical about a centrally located axis 35. The cross sectional views in height of FIGS. 3 through 5 are taken on planes which include such central axis; and, such cross sectional views are identical for either cylindrical or non-cylindrical configuration can bodies.

Curvilinear transition zone 36 interconnects sidewall 34 and bottom-wall 38; and, transition zone 39 interconnects flange metal 32 and sidewall 34 at open end 33. "Transition zone" refers to that area or surface between a sidewall portion of the can body and a portion which is transverse thereto —for example, parallel to the closed end wall. The term is also used in referring to corresponding areas or surfaces of the draw processing tooling which provide the multi-cross sectional areas between open and closed ends of the can bodies.

Compound curvilinear transition zone as used later herein refers to such a zone, or one of its surfaces, which is curvilinear as viewed in height-wise cross section (in a plane which includes the central longitudinal axis of a can body) and, is also curvilinear as viewed in lateral cross section (in a plane which is in perpendicularly transverse relationship to central longitudinal axis). Compound curvilinear transition zones occur in cylindrical or oval can bodies and at rounded corner portions of oblong can bodies.

A large surface area for transition zone 36 is selected to facilitate the wrinkle-free draw processing fabrication as well as for the heat and serve convenience feature of the container.

While work products of FIGS. 3, 4 and 5 are shown with "open end" facing upwardly, they are preferably drawn and redrawn open end down. In a specific embodiment, first and second redraw steps are carried out on opposite ends of the drawn cup to efficiently provide a sidewall with three differing cross sectional areas (in a plane perpendicularly transverse to the centrally located axis) sidewall portions. During the first redraw, the cross-sectional area of bottom wall 38 of work product 30 is changed while the original sidewall portion 34 at open end 33 is maintained. End wall 38 is redrawn to form a new cross-sectional dimension portion 40 (FIG. 4). Bottom wall 42 has a smaller lateral cross section dimension than that of bottom wall 38 of FIG. 3. The decrease in bottom wall dimension, over that of bottom wall 38 adds to the height of sidewall 44. The objective of the draw processing of the invention is for re-shaping to take place without significant change in thickness gage or with a slight decrease in thickness gage. That is, for reshaping to take place without interfering with adhesion of the organic coating as applied.

During fabrication, portion 40 is redrawn with minimal sheet metal and tooling tolerances so as to clamp tightly on the outer periphery of the clamping means so that thickness change, if any, is limited to a small percentage decrease which does not adversely affect organic coating adhesion Transition zone 46 is formed about a redraw punch nose (shown later) to provide for desired access to container contents. Work product shape 48 (FIG. 4) is symmetrical about central axis 49.

Referring to FIG. 5, metal-substrate can body 50 is redrawn from work product 48. The cross-sectional dimension of open end 33 is increased by adding curvilinear transition zone 52 and new (larger cross section dimension) sidewall portion 54; the latter is oriented parallel to centrally located axis 55; overall sidewall height is increased slightly by such addition.

Bottom-wall profiling 56, shown in FIG. 6, is formed after the metal clamping for final redraw is released; and, decreases the height of sidewall portion 44 slightly. Preferably, in commercial practice, bottom wall profiling is carried out at the final redraw station. The bottom wall profiling shown in FIG. 6 facilitates flexing of a central panel portion 57 during the heating-up and cooling stages of a sterilizing process for "sanitary" can packs. Similar profiling can be used on cylindrical and noncylindrical configurations. Additional bottom wall profile configurations are shown schematically later herein.

In a cylindrical or oval can body embodiment of the cross sectional configuration shown in FIG. 6, each of the sidewall cylindrical portions is joined to a next adjacent portion of the can body by a compound-curvilinear transition zone about the full periphery. In can bodies for an oblong configuration, a compound curvilinear transition zone exists at rounded corner portions while, on straight wall portions, the transition is curvilinear only in cross-sectional height-wise-oriented planes which include the centrally located axis of the can body.

Single or double reduced flat rolled steel substrate having a thickness gage of about fifty-five to one hundred ten (55 to 110) #/bb can be used in flat rolled steel embodiments of the present invention. Dimensions for a specific embodiment as shown in FIG. 6, using a sixty-five (65) #/bb organically

| Cross Sectional | Dimension in Inches |
|---|---|
| 60 | 1.456 |
| 61 | 3.900 |
| 62 | 3.690 |
| 63 | 3.100 |
| 64 | 2.800 |
| 65 | 3.420 |
| 66 | 2.065 |
| 67 | 1.677 |
| 68 | 1.178 |
| **Sidewall Portion** | **Height in Inches** |
| 70 | 1.0 |
| 71 | 0.8 |
| 72 | 0.2 |
| **Transition Zone** | **Radius in Inches** |
| 74 | .050 |
| 76 | .050 |
| 78 | .225 |
| 80 | .150 |
| 82 | .150 |

Such open-end cross sectional dimension is minimal for microwave heating; that is, about four inches across the width of the open end of an oblong or oval can body which would have a greater cross sectional length dimension, such as approaching six inches. Such minimum cross sectional dimension should be at least twice the depth of the can body; and, preferably, should be around two and one-half times the depth of the can body.

Transition zone 82 at the bottom wall occupies at least about 0.3"of cross-sectional dimension at that location occupying at least about 20% of the lateral cross sectional projections (onto a plane perpendicularly transverse to such central axis) of the bottom side wall portions of either cylindrical or noncylindrical embodiments. The combined areas of transition zones 78 and 80 are correspondingly larger. Avoiding sharp corner edges contributes to safe and more efficient microwave heating of metal substrate can bodies; and, the extended curvilinear area of the bottom transition zone facilitates access internally for utensils for serving and/or eating directly from the container.

FIG. 7 illustrates how flange metal 84, 85 of can body 86 and a rigid sheet metal substrate end closure 88, respectively, are aligned prior to formation of chime seam 90 (FIG. 8). Chuck wall 92, which, in effect acts as a part of chime seam 90, provides backing for the chime seam juncture between can body 86 and end closure 88.

A rigid metal-substrate end closure is utilized for shipment and long shelf-life storage of soups and similar comestibles to provide dependable tamper-proof and abuse resistant packaging which has not previously been available with containers which could provide for microwave heating of contents in the package after opening. Other closures for the metal-substrate can body of the invention can be used for certain items while still taking advantage of the novel can body; and, means other than a chime seam can be utilized for sealing certain packs.

In a preferred embodiment of a rigid sheet metal substrate can, an easy-open end closure 92 (of circular configuration as illustrated in the plan view of FIG. 9) is joined to a cylindrical can body by chime seam 93. Integral opener 94 is secured to removable full panel 95 by rivet 96; the metal for rivet 96 is unitary with panel 95. An indent 97 is located in recessed profiling panel 98 to improve access to handle end 99 of opener 94. Opening instructions 100 can be embossed in or imprinted on the removable panel 95.

In accordance with this preferred embodiment of the invention, safety-edge shielding is provided for residual scoreline metal after removal of an easy-open panel. The peripherally-located scoreline for a full-panel easy-open end is located contiguously inboard of the end closure chuck wall.

In FIGS. 10, 11, end closure 101 is joined to can body 102 at chime area 103. Bottom wall profiling includes a dome-shaped configuration 104 which can facilitate heating of the contents. Opener 107 is secured to end closure 101 by rivet 108.

The "over-the-rim" opening instructions for a full-panel easy-open convenience-feature end closure using the features illustrated by FIG. 11 are presented in FIG. 9. With the edge shielding features of FIG. 11, scoreline 110 is located between multi-layer folds of sheet-metal at 112, 114. When the handle end of opener 107 is raised its working end contacts multi-layer fold 112; the latter directs the working end of opener 107 toward the recessed panel for rupture of scoreline 110.

Upon removal of the full panel defined by scoreline 110, rounded edge portions of multi-layer folds 112, 114 shield, respectfully, the raw edge of the residual scoreline metal remaining with the can body and that remaining with the separated panel (for further details of such shielding, see pending U. S. patent application Ser. No. 147,267, "MEASURES TO CONTROL OPENING OF FULL PANEL SAFETY-EDGE, CONVENIENCE-FEATURE END CLOSURES" filed by the present applicant and assigned to the same assignee). Other convenience-feature full-open sheet metal end closure embodiments can be used with the invention.

In the embodiment of FIGS. 12, 13 the can body 120 includes an insulating material which extends over the exterior surfaces of sidewall portion 122 and transition zone 124. As seen in FIG. 13, metal substrate 125 includes internal surface organic coating 126 and external surface organic coating 127. An insulating material 128 covers such exterior portions as shown in FIG. 12; such insulating material can comprise laminated or otherwise prepared thickened paper product to increase heat insulating properties. Material 128 also serves as a label.

In the embodiment of FIG. 14, such heat insulating material is used to form a coaster 140 covering the exterior surfaces of transition zone 142 and bottom wall 144. A standard commercial label 146 can be utilized along the sidewall 148. Because of the microwave heating teachings and characteristics of a specific embodiment of the invention, such conventional paper label can be safely used; and, provides the minimal amount of thermal shielding, if any, that may be desired for the can body sidewall.

In the embodiment of FIG. 15 a microwave-transparent cover 150, e.g. made from paper or plastic, is provided. Such cover 150 can serve as a dust cover for the end closure of the sealed container; and/or as a cover for heating (vents such as 152 being provided for such purpose); or, for retaining heat in the can body after heating, when it is to be used as a serving dish.

The multi-layer fold of sheet metal 112 shown in FIG. 15 shields the raw edge of scoreline metal remaining with the container and prevents microwave induced arcing at such raw edges. The remainder of the opened rigid sheet metal package is shielded, for purposes of preventing arcing during microwave heating, by organic coating. The organic coating, and also an intermediate coating such as chrome oxide, can contribute to warm-up of the sheet metal by microwaves because of microwave penetration to and action at the interfaces thereof. Some absorption of magnetic wave energy is believed to occur at or near such interfaces and with the base metal. In addition, steel base metal offers the possibility of some surface warming from the electrical wave energy portion of the microwaves as arcing is inhibited by the organic coating.

in a flat rolled steel substrate embodiment, it has been found that the full volume of the can body, which may be eight to ten ounces of contents by weight depending on the comestible, are heated by microwaves (in a conventional 500 to 700 watt output microwave oven in about three minutes to a temperature between 120° F. to 130° F.; such temperature can be partially dependent on positioning at or slightly above the bottom Pyrex glass or clear hardened plastic cover conventionlly provided within such ovens.

However, with a steel can body, spattering of the contents when heated by microwaves is avoided. Can body warm-up and microwave absorption by the contents at the open surface are provided. As a result, overheating of the contents significantly above eating temperature (about 115° F.) is avoided with microwave heating so that the cover 150 of FIG. 15 is provided largely for holding-in heat and/or moisture.

Also, since the can body is not distorted in shape (as with certain plastic, e.g. styrofoam, packages) and remains rigid it is easier to handle both before and after heating, not only because of its shape but also because of its rigid character. The can body is not overheated by microwave heating. Also the can body and its contents can safely be heated in a conventional oven, The processed foods in "sanitary can packs" do not require "cooking"; they only require heating or warm-up for eating to about 115° F. and therefore, a conventional oven heating temperature of about 150° is adequate; but, the organic coatings and paper can safely withstand temperatures above 350° F. to about 400° F.

The paper labels and coasters are largely for instructions and labeling, but do provide insulation during and after heating and help in handling. Such paper material can safely be heated above 400° F. (but below 450° F.) without igniting Organic coatings can be heated to about 400° F. without detriment to their integrity; since most sanitary packs contain a high percentage of water, the can body is not likely to be heated to that temperature in a conventional oven.

In another cylindrical embodiment of the invention, a punch nose radius of 0.30" is used on a 3.7" diameter punch working into a draw die cavity formed about multiple radii of 0.050", 0.025" and 0.050" entering a die cavity of 3.72".

In the second operation, the end wall of the drawn cup held within 3.72" diameter tooling is redrawn into a first redraw die cavity of 2.69" diameter having an entrance transition zone of 0.20"radius by a 2.675" diameter punch having a 0.20" radius punch nose while using a spring-loaded clamping ring of 3.70" diameter with an outer periphery transition zone radius of 0.125".

The final redraw adds a third diameter portion at the open end of the can body. Dimensions for such tooling, shown in FIG. 16, are tabulated herein; as they indicate minimal sheet metal and tooling tolerances are relied on (65#/bb flat rolled steel has a 0.007" thickness gage and is also coated with organic coating). Such tolerances provide tight clamping on outer peripheries of the multi-dimensional sidewall sections which contributes to the desirable slight decrease in sidewall gage during "draw processing."

FIG. 16 is a cross-sectional view, in part, of tooling for the final redraw (without bottom wall profiling). The shaped work product of the previous preset-stroke draw processing stage is omitted from this "open end" down presentation of redraw tooling. The first redraw punch 160, first redraw clamping ring portion 161 with second redraw punch portion 162, the first redraw die 164, the second redraw die 166 are disposed for relative movement to shape the maximum dimension, second redraw sidewall portion at the open end of the can body.

Dimensions for the tooling (omitting bottom wall profiling) are tabulated with reference to FIG. 16:

| Cross Sectional Reference Number | Cross Sectional Dimension in Inches |
|---|---|
| 170 | 2.691 |
| 171 | 3.724 |
| 172 | 3.924 |
| 173 | 3.697 |
| 174 | 2.675 |
| 175 | 3.900 |
| **Transition Zone Reference Number** | **Cross Sectional Configuration Radius in Inches** |
| 176 | .200 |
| 177 | .132 |
| 178 | .050 |
| 179 | .050 |
| 180 | .200 |
| 181 | .125 |
| 182 | .040 |

Specific dimensions, values and materials have been set forth for purposes of describing the invention and the manner and process of making and using the same;

however, in the light of the teachings provided such dimensions, values and materials can be varied by those skilled in the art while still relying on the invention; therefore, for purposes of determining the scope of the present invention reference should be made to the appended claims.

I claim:

1. A one-piece rigid sheet metal substrate can body for shipping and storing comestibles which can be safely used for heating such contents in a microwave oven and which is suitable for serving and consuming such contents directly therefrom, such can body being shaped solely by draw processing from flat rolled sheet metal substrate precoated with organic coating and draw lubricant on both its planar surfaces, and consisting of a closed bottom wall, a unitary sidewall, and a unitary transition zone interconnecting such bottom wall and sidewall, each coated with organic coating on interior and exterior surfaces thereof, such sidewall defining an open end for such can body which is oppositely disposed in relation to such bottom wall along a centrally located axis which is perpendicular to the plane of such bottom wall and open end, such sidewall being symmetrically disposed in relation to such axis, such sidewall including at least three sidewall portions defining differing cross-sectional areas as projected onto a plane which is perpendicularly transverse to such axis than a similar projection of such closed bottom wall, with the sidewall portion defining the largest cross-sectional area being contiguous to such open end of the can body, and, with sidewall portions defining progressively smaller cross-sectional areas being disposed toward such closed bottom wall of the can body such that the sidewall portion defining the smallest cross-sectional area is interconnected to such bottom wall by such transition zone, such transition zone when projected onto a plane which is perpendicularly transverse to the centrally located axis defines an area which is at least about 20% of the cross-sectional area of a similar projection of the cross-sectional area of such sidewall portion which is interconnected with such bottom wall, such sidewall portions defining differing cross-sectional areas being joined to adjacent portions of the one-piece can body by transition zones which are curvilinear in cross-sectional configuration as projected onto a longitudinal cross-sectional plane which includes such centrally located axis, and, in which such open end cross-sectional area extends to about 40% larger than such closed bottom wall cross-sectional area, and the minimum cross-sectional dimension measured in a lateral plane which is perpendicularly transverse to such central axis at such open end is at least about four inches.

2. The structure of claim 1 in which such metal substrate of the can body comprises flat rolled steel, having a gage in the range of about 55 to about 110#/bb, selected from the group consisting of single-reduced and double-reduced flat rolled steel.

3. The structure of claim 2, further including a metallic-material coating on each surface of such flat rolled steel intermediate such steel surface and such organic coating on interior and exterior surfaces of such can body, such intermediate metallic-material coating being selected from the group consisting of chrome oxide, chrome and chrome oxide, tin, tin-iron alloy, and tin and tin-iron alloy.

4. An integral package comprising (A) a one-piece rigid sheet metal substrate can body having a closed bottom wall, a unitary sidewall defining an open end for such can body, and a unitary transition zone interconnecting such bottom wall and sidewall;

such can body being shaped entirely by draw processing of flat rolled sheet metal substrate precoated in flat rolled form on both its surfaces with organic coating and draw lubricant, such can body presenting such organic coating on both interior and exterior surfaces thereof, such sidewall being symmetrically disposed about a centrally located axis which extends in perpendicular relationship to the plane of such bottom wall and such open end, a transition zone being curvilinear in a heightwise-oriented cross-sectional plane which includes such centrally located axis, such sidewall including at least three sidewall portions defining different cross-sectional areas than such bottom wall, with the sidewall portion defining the largest cross-sectional area being contiguous to such open end of the can body, with remaining sidewall portions defining smaller cross-sectional areas being disposed with such progressively smaller cross-sectional areas extending toward such closed bottom wall, with no interior sidewall portion of the can body defining a larger cross-sectional area than such larger cross-sectional area portion located at such open end of the can body; and, in which such sidewall portions defining differing cross-sectional areas being joined to adjacent portions of the one-piece can body by transition zones which are curvilinear as projected onto a cross-sectional plane which includes such centrally located axis;

(B) a non-unitary end closure for sealing such open end of the can body, and (C) means joining sheet metal substrate at such open end of the can body to such end closure to seal such open end of the can body.

5. The structure of claim 4 in which such transition zone interconnecting such sidewall portion and bottom wall, when projected onto a plane which is perpendicularly transverse to the centrally located axis, defines a projected area which is at least about 20% of the corresponding cross-sectional area.

6. The structure of claim 5 in which the cross-sectional area defined by such open end sidewall portion is at least about 25% larger than that at such sidewall portion which is interconnected with such bottom wall, and such open end sidewall portion defines a minimum cross-sectional dimension of at least about four inches.

7. The structure of claim 4 further including a heat insulating covering on the external surface of at least a major portion of such sidewall portion, bottom wall and interconnecting transition zone of such metal-substrate can body.

8. The structure of claim 7 in which such insulating covering consists essentially of a cellulose material having a thickness dimension in the range of about 1/32" to about 3/32".

9. The structure of claim 4 in which such end closure is formed from rigid sheet metal substrate, and such metal-substrate end closure is joined to such metal-substrate can body to seal such can body forming an integral rigid sheet metal substrate can.

10. A tamper-evident, abuse-resistant sanitary pack for comestibles which is self-supporting for shipment or storage, and provides for:

long shelf life of processed contents without freezing, heating of such contents including use of microwaves after opening such package, and serving and/or eating of such heated contents directly from the opened package, comprising the structure of claim 9 in which such sheet metal consists essentially of flat rolled steel, such can body prior to sealing presents peripheral flange metal about its open end, such flange metal extends with a component in a direction transverse to such centrally located axis of the can body beyond such sidewall portion defining the larger dimension open end of such can body, such metal-substrate end closure prior to sealing presents flange metal about its periphery, and a chime seam is formed using such flange metal at the open end of the can body and at the periphery of such end closure, and, further including a chuck wall which is a unitary part of such end closure and forms a part of and helps to provide backing for such chime seam, such chuck wall being contiguous to the interior surface of such sidewall portion at the open end of such can body and having a matching configuration in cross section therewith.

11. The structure of claim 10 in which such can body sheet metal comprises flat rolled steel of a gage in the range of about 55 to about 110#/bb selected from the groups consistig of single-reduced and double-reduced flat rolled steel, and, further including a metallic-material coating on each surface of such flat rolled steel intermediate such steel and such organic coating, such intermediate metallic-material coating being selected from the group consisting of chrome oxide, chrome and chrome oxide, tin, tin-iron alloy, and tin and tin-iron alloy.

12. The structure of claim 11 in which such can body has a minimum cross sectional dimension at its open end of about four inches, and the overall depth dimension of such can body is in the range of about $\frac{1}{3}$ to about $\frac{1}{2}$ such cross sectional dimension of such sidewall portion at the open end of the can body, and the minimum cross sectional dimension of such open-end sidewall portion is no more than about $\frac{1}{3}$ larger than the minimum cross sectional dimension of such smaller cross sectional area sidewall portion interconnected to such bottom wall of the can body.

13. The structure of claim 10 further including an over-cap means in which such over-cap means attaches over such chime seam after unsealing such can body by removing of such full panel from such end closure, and such over-cap includes means for venting such can body during heating of such package contents.

14. The structure of claim 9 in which such integral can as assembled after filling such can body with one or more comestibles is opened by removing a full panel portion of such end closure.

15. The structure of claim 14 in which such rigid metal substrate end closure comprises an easy-open end closure having a peripherally-located scoreline of decreased sheet metal thickness for defining a full panel to be removed from such end closure, and an opener is secured to the outer surface of such full panel of the end closure, such scoreline being contiguous to and having a matching configuration to such end closure chuck wall.

16. The structure of claim 15 in which residual raw edge metal which remains with such can body after removal of such end closure panel is shielded from direct access by a contiguous multi-layer fold of sheet metal located on the portion of such end wall closure remaining with such can body, such sheet metal fold being disposed contiguous to and intermediate such scoreline and such chuck wall.

17. The structure of claim 4 further including an over-cap means placed over such integral end closure at such open end of the can body, such over-cap means being transparent to microwaves to enable heating of the contents of such can body by passage of microwaves through such over-cap means as placed in such can body after unsealing of such can body and removing of such end closure therefrom.

18. The structure of claim 17 in which such over-cap means consists essentially of a cellulose material.

19. Method for fabricating a rigid sheet metal substrate can body for a convenience package providing for shipment and storage of comestibles without freezing, heating of such contents by microwave after opening, and serving and/or eating of heated comestibles directly from such can body comprising providing a rigid sheet metal substrate selected from the group consisting of flat-rolled steel of about 55 to about 110#/bb and flat-rolled aluminum of a thickness gage between about 0.007" and about 0.012", forming a one-piece can body from such metal substrate entirely by draw processing, such can body being symmetrically disposed about a central longitudinal axis, such can body having a sidewall defining an open end at one axial end of the can body for introducing or removing comestibles, a closed bottom wall at the remaining axial end of the can body, a unitary, curvilinear, transition zone interconnecting such sidewall and closed bottomwall, such sidewall including at least three portions which define differing lateral cross-sectional areas as measured in a plane which is perpendicularly transverse to such central axis, with the portion defining the larger cross-sectional area being formed during a final redraw operation and located contiguous to such open end of the can body, the portion defining the smallest cross-sectional area during a first redraw operation and interconnected with such closed bottom wall of the can body, and with all such sidewall portions being interconnected at each respective longitudinal end with a next adjacent sidewall portion of the can body by a unitary interconnecting, curvilinear-cross section transition zone of diminishing cross-sectional area in approaching such bottom-wall, and with the interior sidewall portions of the can body defining progressively smaller cross-sectional areas in moving from such open end of the can body to such bottom wall.

20. The method of claim 19 in which such can body is formed with flange metal at its open end, such flange metal being disposed in a generally outwardly direction in relation to such central axis and being transversely oriented in relation thereto, further including providing a rigid, steel-substrate, non-unitary end closure for such open end of the can body, such end closure having flange metal extending uniformly about its periphery, making such end closure integral with such can body by forming a chime seam from such flange metal at the open end of the can body sidewall and around the periphery of such end closure; and applying insulating covering on at least a portion of the exterior of such sidewall.

* * * * *

UNITED STATES PATENT AND TRADEMARK OFFICE

CERTIFICATE OF CORRECTION

PATENT NO. : 4,875,597

DATED : October 24, 1989

INVENTOR(S) : William T. Saunders

It is certified that error appears in the above–identified patent and that said Letters Patent is hereby corrected as shown below:

Column 2, line 37, "resented" should read --presented--.
Column 3, line 21, ""work" should read --"Work--;
"" line 29, "batch" should read --bath--;
"" lines 40-41, "steel engineers" should read --Steel Engineers--;
"" line 63, "contribution" should read --contributions--.
Column 5, line 29, after "organically" insert --coated TFS are as follows:--.
Column 7, line 40, "in" should read --In--.
Column 11, line 56, "groups consistig" should read --group consisting--.

Signed and Sealed this

Twenty-fifth Day of September, 1990

*Attest:*

HARRY F. MANBECK, JR.

*Attesting Officer*

*Commissioner of Patents and Trademarks*